US005590886A

United States Patent [19]

Lush

[11] Patent Number: 5,590,886

[45] Date of Patent: Jan. 7, 1997

[54] REUSABLE PAINT BALL GRENADE, RELOADABLE WITH STANDARD .68 CALIBER PAINT BALLS

[76] Inventor: Craig L. Lush, 8148 Cliffview Ave., Springfield, Va. 22153

[21] Appl. No.: 510,101

[22] Filed: Aug. 1, 1995

[51] Int. Cl.[6] ..... A63B 65/00

[52] U.S. Cl. ..... 473/577; 102/498; 102/513

[58] Field of Search ..... 273/418, 428; 102/498, 513, 502; 446/267, 473, 475

[56] References Cited

U.S. PATENT DOCUMENTS

| | | | |
|---|---|---|---|
| 4,932,329 | 6/1990 | Logie | 273/418 X |
| 4,932,672 | 6/1990 | Tippmann | 273/418 X |
| 4,944,521 | 7/1990 | Greeno | 273/428 |
| 5,018,449 | 5/1991 | Eidson, II | 273/418 X |
| 5,240,450 | 8/1993 | Graham | 273/418 X |
| 5,354,225 | 10/1994 | Hix | 273/428 X |

*Primary Examiner*—Paul E. Shapiro

[57] ABSTRACT

Reusable, mechanically powered Paint Ball Grenade utilizing 0.68 or smaller diameter paint balls. Accepting and storing said paint balls between its upper and lower sections and behind a fingerguard. The device is designed to be grasped in such a way as to engage one or more safety interlocks during the removal of the safety pin. Once thrown downrange the actuator will function upon impact allowing the grenade halves to collapse with the force of the primary spring, crushing the paint balls against cutters and causing the paint to be hydromechanically dispersed about the exterior of the device. The device may be reloaded by expanding the two halves, thus compressing the primary spring, reinserting the safety pin, and reloading new paint balls.

4 Claims, 8 Drawing Sheets

AA

BB

Figure 6a.
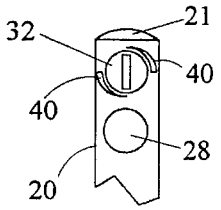
Figure 6b.
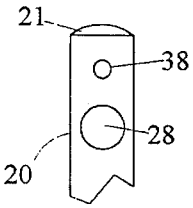
Figure 6c.
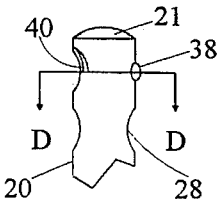
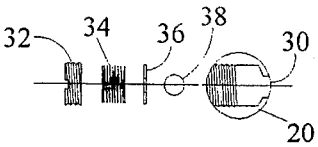
Figure 6d.
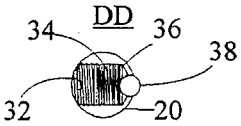
Figure 6e.
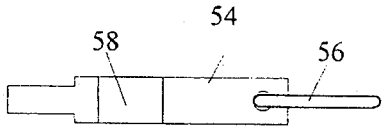
Figure 7a.
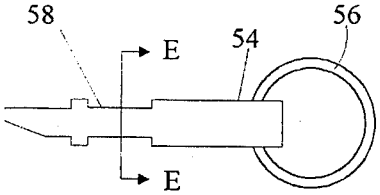
Figure 7b.
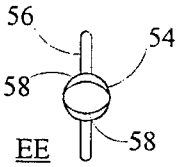
Figure 7c.
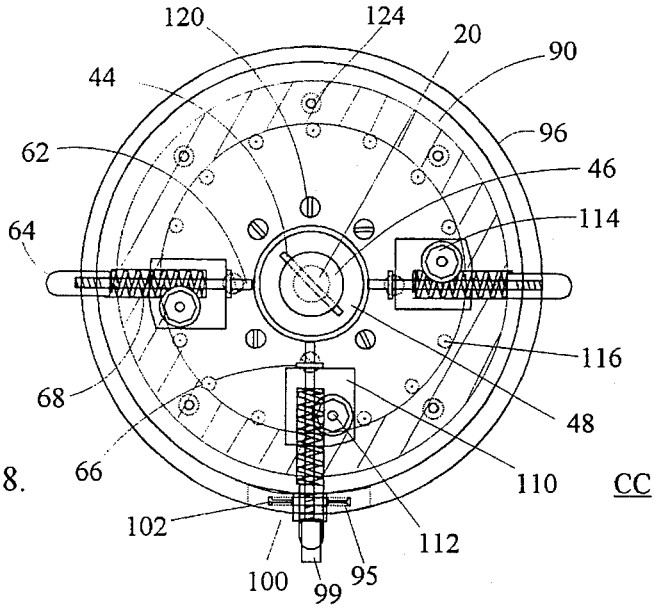
Figure 8.

REUSABLE PAINT BALL GRENADE, RELOADABLE WITH STANDARD .68 CALIBER PAINT BALLS

CROSS REFERENCES TO RELATED APPLICATIONS

None.

BACKGROUND—FIELD OF INVENTION

This invention relates to marking devices, specifically to an improved recreational Paint Ball grenade that may be reloaded with 0.68 caliber paint balls, and reused.

BACKGROUND—DESCRIPTION OF PRIOR ART

A Paint Ball grenade is a device by which quantities of paint are delivered and dispensed to a location remote from the user with the intent of eliminating an opponent from a recreational Paint Ball game. The generally accepted rules of Paint Ball preclude any participant from continuing to play subsequent to receiving a paint marking. Paint Ball is a relatively immature sport that simulates combat situations in a non-lethal environment. Other than the fundamental armament, the Paint Ball Gun, few complex devices have been developed.

Heretofore, Paint Ball grenades have been relatively crude devices, limited in design to a single usage. One such system, shown in U.S. Pat. No. 4,932,672 is a grenade comprised of a length of rubberized material similar to a bicycle tire innertube, filled to excess capacity with paint, sealed on its ends, folded in the center, reinformed by a net wrap, and fitted with an electrical connector cap over the adjacent sealed ends. An automotive type cotter pin extends through the electrical connector, and with its associated pull ring, simulates the traditional grenade pin present in functioning military grenades. Instructions for this device require the user to "pull pin, remove cap," and note that the grenade "will go off on impact". Additional instructions suggest user shake grenade "before game use to dissolve sediment." The contents are dispensed with a flailing action in the immediate vicinity of its impact. Subsequent to this one time use, the player must retrieve, remove, and dispose of the rubber paint casing, as well as the cap and cotter pin which comprise the grenade.

OBJECTS AND ADVANTAGES

Accordingly, several objects and advantages of my invention are as follows: it provides superior size, weight and aerodynamic characteristics from the prior art; it has a bail by which it may be secured and transported prior to use during a game; it may be stored unloaded in a wide variety of environments, unaffected by extreme heat or cold; it has a predetermined and predictable dispersal pattern; it is easily refillable and reusable in subsequent games; it cannot be reloaded and reused during a Paint Ball game by anyone not possessing the appropriate grenade pin, thereby reducing the possibility of being claimed and used against its owner; it has multiple safety interlocks to minimize inadvertent actuation, and physical restraints to preclude injury in the event of catastrophic failure; it has an adjustable actuator; may be easily uploaded to change or blend color combinations at will; and it contains an internal environmentally friendly renewable (resettable) power source facilitating its application as a mine-like device actuated by any of a variety of mechanical triggering mechanisms.

Still further objects and advantages will become apparent from a consideration of the ensuing description and accompanying drawings.

BRIEF DESCRIPTION OF THE DRAWINGS

FIG. 6*a* is a view of center post displaying the rear of the actuator mechanism.

FIG. 6*b* is a view of the center post displaying the front of the actuator mechanism.

FIG. 6*c* is a view of the center post displaying the side of the actuator mechanism.

FIG. 6*d* shows the center post with top view of exploded actuator mechanism.

FIG. 6*e* shows Section DD, a top view of actuator mechanism within the center post.

FIG. 7*a* is a top view of the grenade pin.

FIG. 7*b* is a front view of grenade pin.

FIG. 7*c* shows Section EE, a cross-section of the grenade pin cam.

FIG. 8 shows Section CC of grenade, including top view of finger guard with the safety interlock pins in the "at-rest" position.

LIST OF REFERENCE NUMERALS

20 Center Post

21 Center Post Spherical Top

22 Center Post Base
24 Center Post Thru-Hole for Power Spring Retaining Pin
26 Center Post Notch for Safety Interlock Pin
28 Center Post Thru-Hole for Grenade Pin
30 Center Post Thru-Hole for Actuator Mechanism
32 Actuator Adjusting Screw
34 Actuator Spring
36 Actuator Washer
38 Actuator Ball
40 Actuator Adjustment Marking
44 Power Spring Retaining Pin
45 Retaining Pin Installation Hole
46 Washer
48 Power Spring Guard
50 Power Spring
54 Pin
56 Pull Ring
58 Cam
62 Safety Interlock Pin
64 Safety Interlock Handle
66 Retaining Clip
68 Safety Interlock Spring
72 Cap
73 Load/Pull Pin Orientation Marking
74 Cap Threads
75 Safe Pin Orientation Marking
76 Cap Thru-Hole for Grenade Pin
78 Cap Thru-Hole for Center Post
80 Cap Neck-down Actuator interface
82 Cap Bearing Surface for Center Post
84 Bail
86 Shoulder Screw
90 Upper Housing
92 Upper Housing Threads
94 Upper Housing Thru-Hole for Safety Interlock Handle
95 Finger Guard Door Hinge Slot
96 Finger Guard
97 Loading Door Closure Tab
98 Finger Guard Paint Dispersal Port 99 Loading Door Safety Cam
100 Loading Door
101 Loading Door Paint Port
102 Loading Door Hinge Pin
103 Loading Door Safety Interlock Pendulum
104 Loading Door Safety Interlock Stop
105 Loading Door Finger Tab
107 Finger Guard Blind-hole for Ball Cutter
108 Finger Guard Void for Ball Cutter Retainer Displacement
109 Finger Guard Race for Ball Cutter Retainer
110 Safety Interlock Housing
112 Bolt
114 Captured Locking Nut Assembly
116 Ball Cutter
118 Core
119 Core Thru-Hole for Center Post
120 Core Retaining Screw
121 Ball Cutter Retainer
122 Ball Cutter Retainer Thur-Hole for Core
124 Finger Guard Retaining Screw
126 Paint Ball
128 Lower Housing
130 Foot
132 Lower Housing Thru-Hole for Center Post
136 Lower Housing Drain Hole
138 Liner
140 Liner Paint Ball Race
142 Liner Thru-Hole for Center Post
144 Liner Drain Holes
146 Liner Retaining Screw

SUMMARY

The object of my invention is a paint ball grenade for the dispersal of paint from 0.68 caliber or smaller paint balls through a spring powered crushing action, and controlled by a variable, mechanical actuator mechanism.

DESCRIPTION OF INVENTION—PREFERRED EMBODIMENT

Figure 1A:
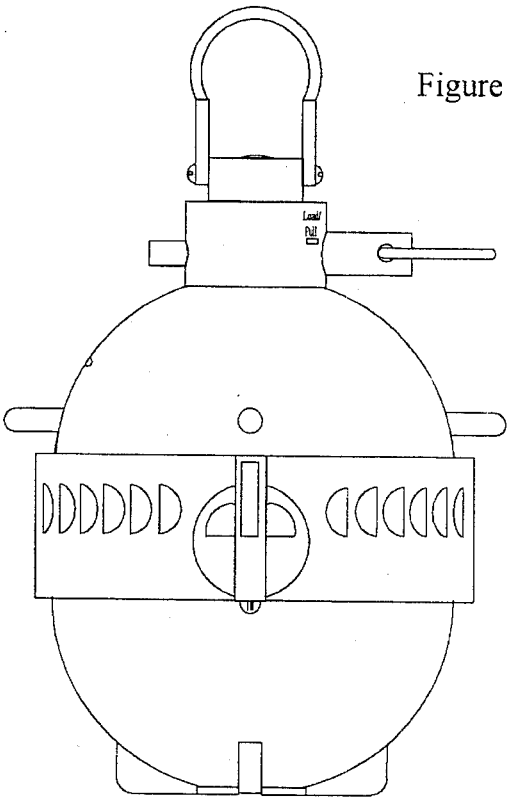
FIG. 1*a* is a front view of grenade in the loaded configuration with pin in the load/pull position.

FIG. 1*a* shows a plain front view of a paint ball grenade in the loaded configuration with pin installed and in the load/pull configuration. This view is suitable for publication in the Gazette.

Figure 1B:
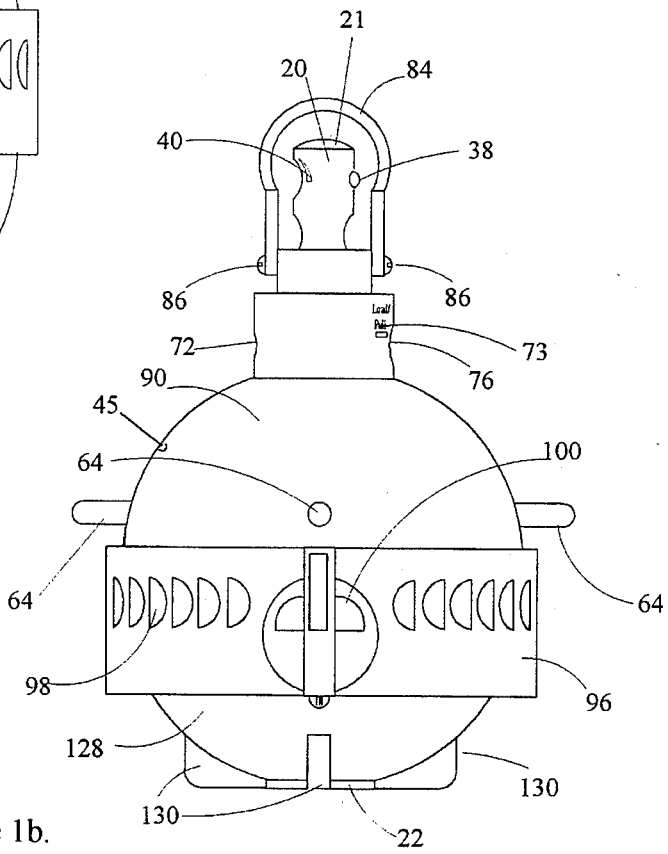
FIG. 1*b* is a front view of grenade in the unloaded or functioned configuration.

FIG. 1*b* is a front view of a paint ball grenade as shown in FIG. 1*a*. This view depicts the unloaded or functioned configuration. The grenade is comprised of a cylindrical center post (20) passing longitudinally through the grenade. A center post base (22) exists at the bottom, or base end of center post (20) and center post spherical top (21) exists at the opposite, or uppermost end of center post (20). Located within center post (20), directly below spherical center post top (21) is the actuator mechanism that will be fully discussed in FIG. 6. Actuator ball (38), and actuator adjustment marking (40) are visible in FIG. 1*b*. A handle or bail (84) is attached to cap (72) by means of a shoulder screw (86) at the terminating ends of bail (84). A load/pull pin orientation marking (73) is visible adjacent to cap thru-hole for grenade pin (76). Cap (72) is attached to upper housing (90) by means of cap threads (74) and upper housing threads (92) which will be discussed in FIG. 11. A retaining pin installation hole (45) is also visible on upper housing (90). Three safety interlock handles (64) are visible extending through the upper housing (90) above the finger guard (96). Finger guard paint dispersal port (98) extend through the finger guard (96). A loading door (100) is attached to finger guard (96). The lower housing (128) is visible extending below the finger guard (96). A foot (130) extends below the lower housing (128). Various configurations of Foot (130) may be produced separately and attached to the lower housing (128) or may exist integrally as a result of the lower housing (128) production.

Figure 2A:
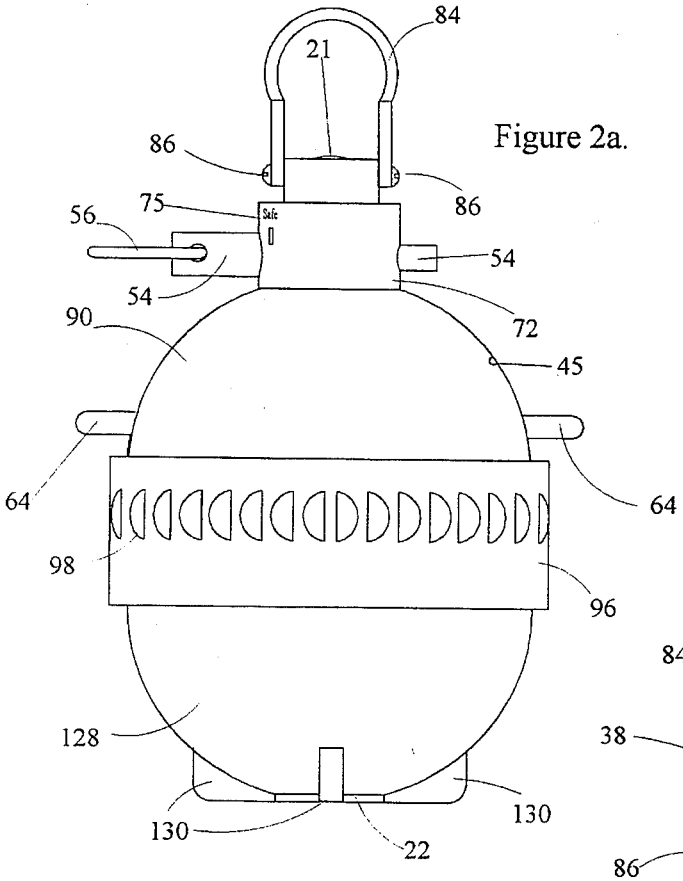
FIG. 2*a* is a back view of grenade in loaded configuration with pin in the load/pull position.

FIG. 2*a* is a rear or back view of a paint ball grenade in the loaded configuration with pin (54) in the load/pull position as evidenced by the orientation of pull ring (56). Spherical center post top (21) protrudes above the top edge of cap (72). A center post base (22) is again evidence at the bottom of the device, exterior to lower housing (128) adjacent to and forming a common bottom plane with foot (130). Finger guard (96) showing configuration of finger guard paint dispersal port (98) on the back side of grenade is also displayed. Two safety interlock handles (64), visible from the back, protrude through upper housing (90). Cap (72) displays safe pin orientation marking (75). Bail (84) is attached to cap (72) by Shoulder screw (86) at the terminating ends of bail (84). A retaining pin installation hole (45) is also visible on upper housing (90).

Figure 2B:
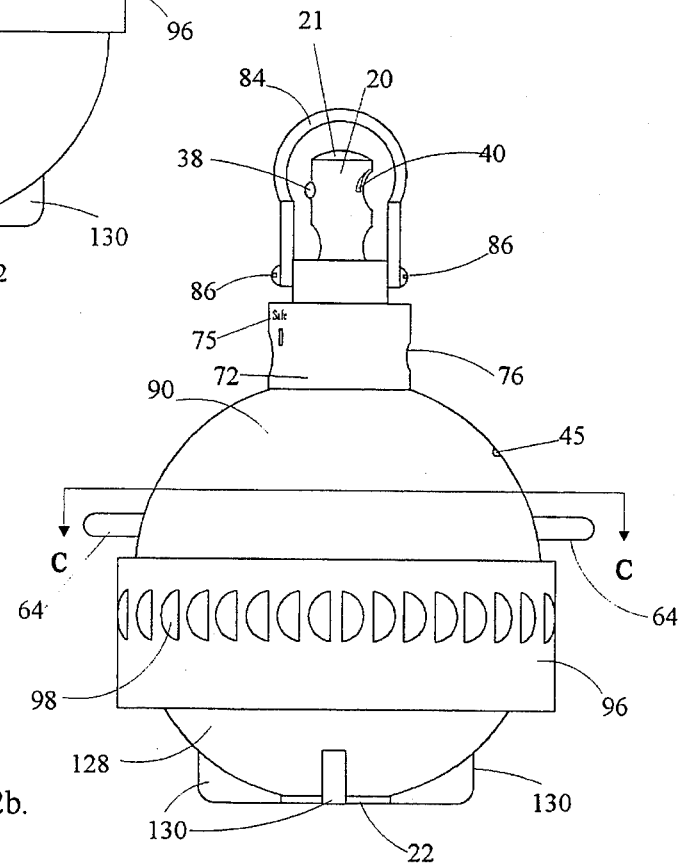
FIG. 2*b* is a back view of grenade in the functioned or unloaded configuration.

FIG. 2*b* is a back view of a paint ball grenade in the functioned or unloaded configuration. The grenade is comprised of a cylindrical center post (20) passing longitudinally through center of the device and protruding above the top edge of cap (72). Located within center post (20) and below spherical center post top (21) is the actuator mechanism that will be discussed in FIG. 6. Actuator ball (38), and actuator adjustment marking (40) are visible in FIG. 2*b*. A center post base (22) is again evidenced at the bottom of the device, protruding below the lower housing (128) adjacent to and forming a common bottom plane with foot (130). The finger guard (96) showing configuration of finger guard paint dispersal port (98) on the back side of the device is also displayed. Two safety interlock handles (64), visible from the back, protrude through the upper housing (90). Cap (72) displays the said pin orientation marking (75) adjacent to the cap thru-hole for grenade pin (76). Bail (84) is attached to cap (72) by Shoulder screw (86) at the terminating ends of bail (84). A retaining pin installation hole (45) is also visible on upper housing (90).

Figure 3:
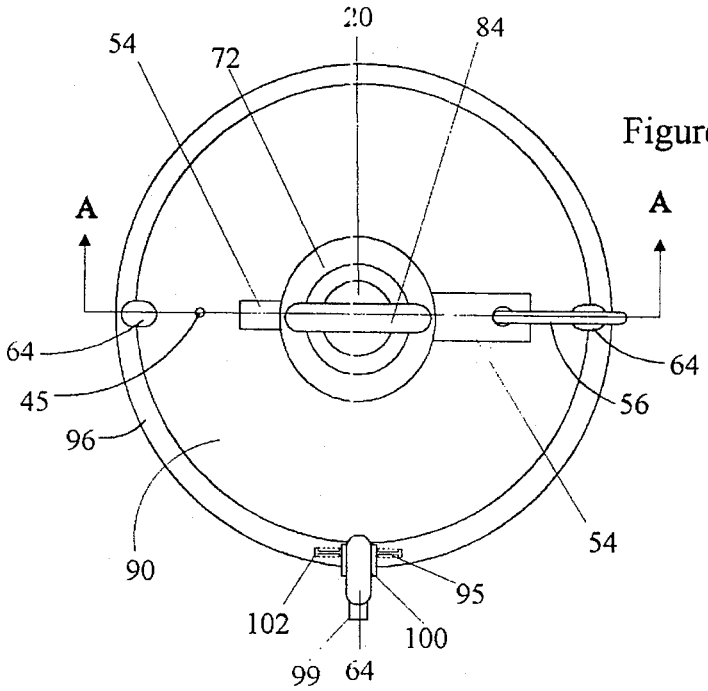
FIG. 3 is a top view of grenade in the loaded configuration with pin in the safe position and safety interlock handles engaged.

FIG. 3 is a top view of a paint ball grenade in the loaded configuration with pin (54) in the safe position as evidenced by orientation of pull ring (56). Center post (20) is visible beneath bail (84) and within cap (72). Three safety interlock handles (64), displayed in the engaged position, and retaining pin installation hole (45) are visible on upper housing (90). Finger guard (96) displays loading door hinge pin (102) positioned within the finger guard door hinge slot (95). Loading door (100) and loading door safety cam (99) are visible protruding from finger guard (96).

Figure 4:
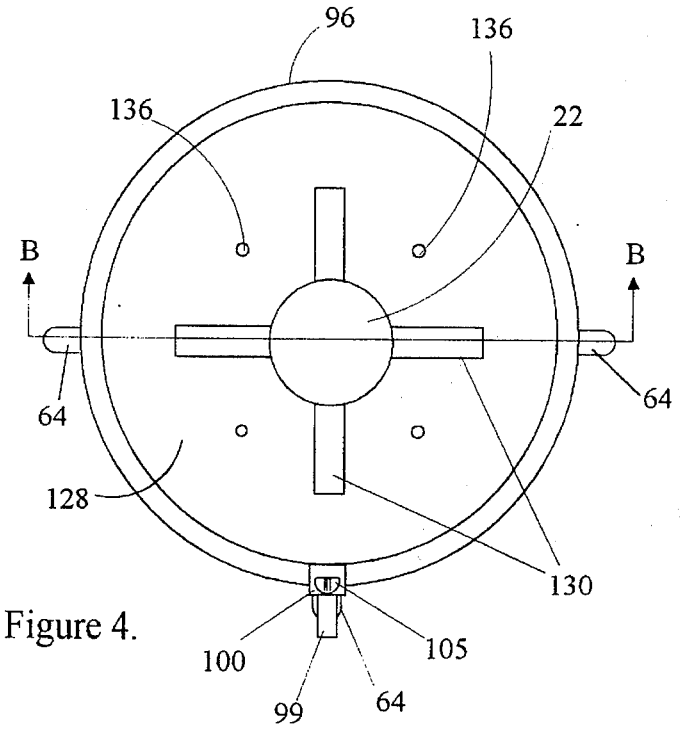
FIG. 4 is a bottom view of grenade in the unloaded or functioned configuration.

FIG. 4 is a bottom view of a paint ball grenade in the unloaded or functioned configuration. Four each foot (130) are located adjacent to center post base (22). Four each lower housing drain hole (136) are shown on the lower housing (128). Three safety interlock handles (64) in the at-rest position are visible above finger guard (96). Loading door (100), loading door safety cam (99), and loading door finger tab (105) protrude from finger guard (96).

Figure 5A:
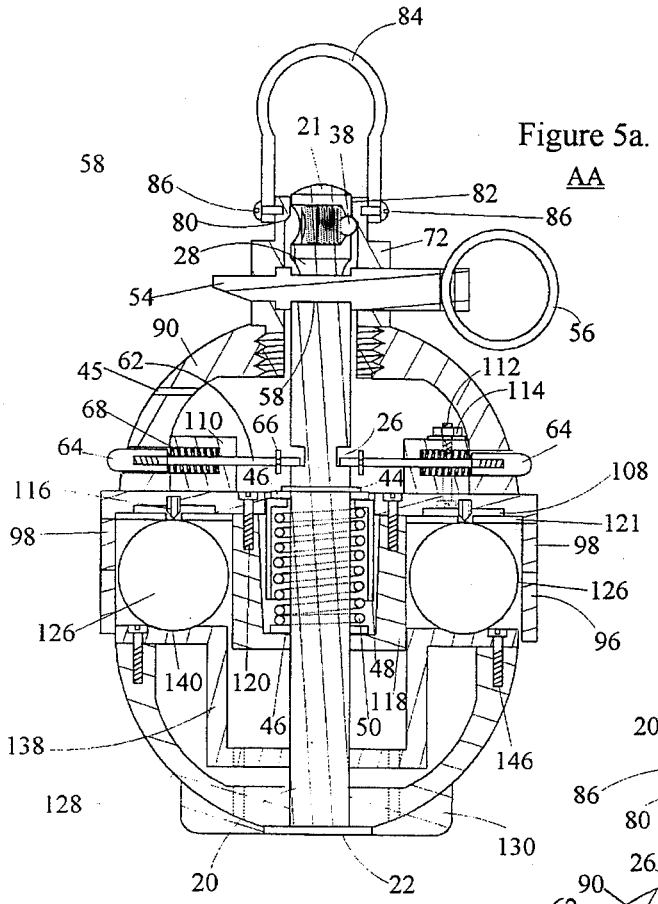
FIG. 5*a* shows Section AA of grenade in the loaded configuration with pin in the safe position.

FIG. 5*a* shows section AA (FIG. 3) of grenade in the loaded configuration with pin (54) in the safe position as evidenced by orientation of pull ring (56) and cam (58) interlocked with center post thru-hole for grenade pin (28). Center post (20), having a center post notch for safety interlock pin (26), a center post base (22), and spherical center post top (21) extends longitudinally through the device. Cap (72) contains longitudinal cap thru-hole for center post (78) with a cap neck-down actuator interface (80) below cap bearing surface for center post (82). Cap neck-down actuator interface (80) retains the spring loaded actuator ball (38) prior to functioning. Bail (84) is attached to cap (72) by means of a shoulder screw (86) at the terminating ends of bail (84). Upper housing (90) contains a retaining pin installation hole (45). Finger guard (96) displays Finger guard paint dispersal ports (98) and provides location and position for ball cutter (116) and a finger guard void for ball cutter retainer displacement (108). Directly below Finger guard void for ball cutter retainer displacement (108) and contained within vertical walls of finger guard (96) is housed a ball cutter retainer (121). Above finger guard (96), and attached with bolt (112) and captured locking nut assembly (114), is a safety interlock housing (110). Safety interlock housing (110) retains safety interlock handle (64) attached to safety interlock pin (62) and safety interlock spring (68). A retaining clip (66) is attached to safety interlock pin (62) and limits travel of safety interlock pin (62) and safety interlock handle (64). Below finger guard (96), and attached with core retaining screw (120), is a core (118). Multiple paint balls (126) may be contained between core (118) and the vertical wall of finger guard (96). Above core (118) and surrounding center post (20) is a washer (46), a power spring (50), a power spring guard (48), and a second washer (46) which are held in place with a power spring retaining pin (44) which passes thru center post (20). Attached to the top surface by liner retaining screw (146), and contained within lower housing (128) is liner (138). A liner paint ball race (140) is contained within the top surface of liner (138). A foot (130) is attached to lower housing (128) adjacent to center post base (22).

Figure 5B:
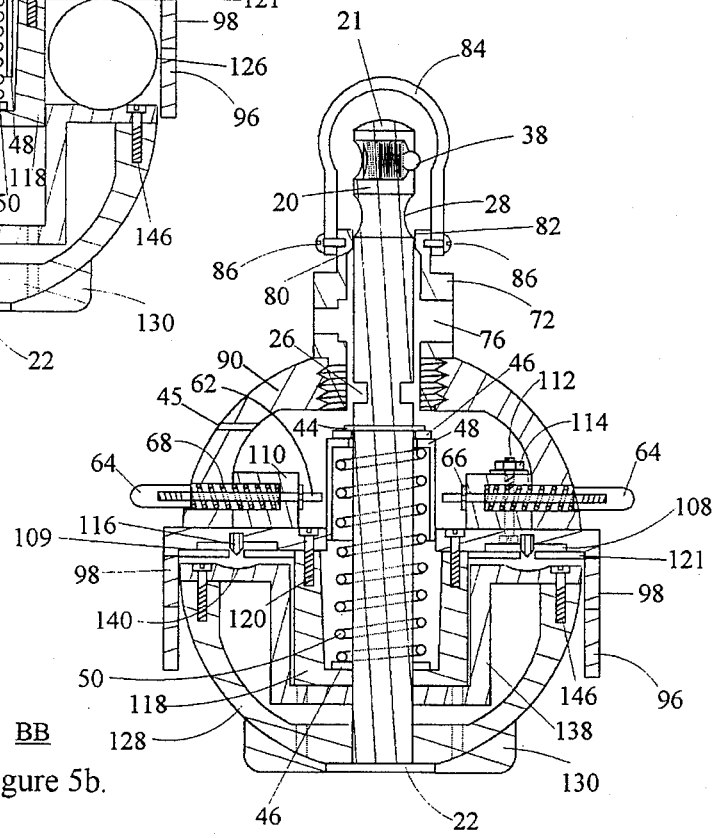
FIG. 5*b* shows Section BB of grenade in the unloaded or functioned configuration.

FIG. 5*b* shows section BB (FIG. 4) of a paint ball grenade in the unloaded or functioned configuration as evidenced by the extension of center post (20) and center post spherical top (21) above cap (72) and the absence of paint ball (126) between the liner paint ball race (140) and ball cutter retainer (121). Power spring (50) is extended and power spring guard (48) precludes the engagement of safety interlock pin (62) with safety interlock handle (64) into the now misaligned center post notch for safety interlock pin (26). Safety interlock spring (68) maintains safety interlock pin (62) against safety interlock housing (110), limited by retaining clip (66). Safety interlock housing (110) is attached to top horizontal surface of finger guard (96) by bolt (112) and captured locking nut assembly (114). Center post thru-hole for grenade pin (28) extends above cap (72) and actuator ball (38) is disengaged from cap neck-down actuator interface (80). Center post (20) now extends from center post base (22) between foot (130) and below lower housing (128) thru cap bearing surface for center post (82). Cap thru-hole for grenade pin (76) is empty and bail (84) extends above cap (72) and over center post (20), being attached to cap (72) by means of a shoulder screw (86) at the terminating ends of bail (84). Power spring retaining pin (44) is installed through retaining pin installation hole (45) in upper housing (90). Power spring retaining pin (44) retains washer (46) and power spring guard (48) against top of power spring (50), while lower washer (46) rests between bottom of power spring (50) and the inner or top horizontal surface of core (118). Core (118) is attached to lower horizontal surface of finger guard (96) by core retaining screw (120). Finger guard (96), containing finger guard paint dispersal ports (98), is attached to the lower surface of upper housing (90) and contains on its lower horizontal surface ball cutter (116), finger guard void for ball cutter retainer displacement (108), and a finger guard race for ball cutter retainer (109). Liner (138) is attached to lower housing (128) with liner retaining screw (146).

FIG. 6*a* is a back view of the center post (20) showing center post thru-hole for grenade pin (28), spherical center post top (21), actuator adjusting screw (32), and actuator adjustment marking (40).

FIG. 6*b* is a front view of center post (20)_ showing the center post thru-hole for grenade pin (28), spherical center post top (21), and actuator ball (38).

FIG. 6*c* is a side view of center post (20) showing center post thru-hole for grenade pin (28), spherical center post top (21 ), actuator ball (38), and actuator adjustment marking (40).

FIG. 6*d* is an exploded top view of actuator components, including actuator adjusting screw (32), actuator spring (34), actuator washer (36), and actuator ball (38) as they are assembled within center post thru-hole for actuator mechanism (30), of center post (20).

FIG. 6*e* shows Section DD (FIG. 6*c*), of center post (20) with actuator adjusting screw (32), actuator spring (34), actuator washer (36), and actuator ball (38).

FIG. 7*a* is a top view of pin (54), showing pull ring (56), and cam (58).

FIG. 7*b* is a front view of pin (54), showing pull ring (56), and cam (58).

FIG. 7*c* shows Section EE (FIG. 7*b*) of cam (58), with pin (54), and pull ring (56).

FIG. 8 shows Section CC (FIG. 2*b*) including top view of finger guard (96) thru sectioned upper housing (90). Evident are safety interlock housing (110), bolt (112), captured locking nut assembly (114), safety interlock pin (62), Safety interlock handle (64), Retaining clip (66), and safety interlock spring (68). Center post (20) with power spring retaining pin (44), washer (46), and power spring guard (48) are also visible. New to this view is the location of finger guard retaining screw (124), which attaches finger guard (96) to the upper housing (90). Also visible are location and frequency of core retaining screw (120), and ball cutter (116). Loading door (100), loading door safety cam (99), loading door hinge pin (102), and finger guard door hinge slot (95) are also visible.

Figure 9A:
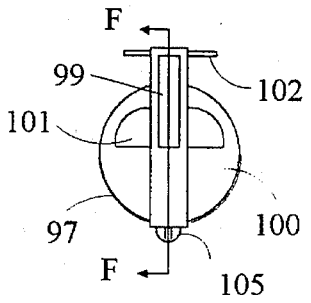
FIG. 9*a* is a front view of the loading door.

FIG. 9*a* is a front view of loading door (100), which includes loading door safety cam (99), loading door hinge pin (102), loading door paint port (101), Loading door closure tab (97), and loading door finger tab (105).

Figure 9B:
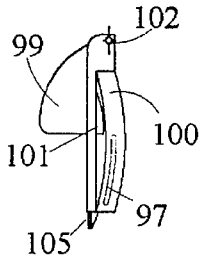
FIG. 9*b* is a side view of the loading door.

FIG. 9*b* is a side view of loading door (100), which includes loading door safety cam (99), loading door hinge pin (102), loading door paint port (101), Loading door closure tab (97), and loading door finger tab (105).

Figure 9C:
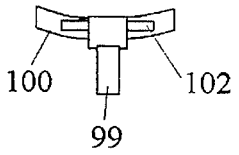
FIG. 9*c* is a top view of the loading door.

FIG. 9*c* is a top view of loading door 100, which includes loading door safety cam 99, and loading door hinge pin 102.

Figure 9D:
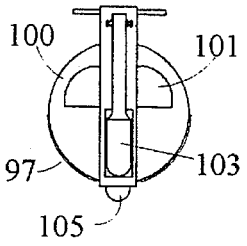
FIG. 9*d* is a back view of the loading door.

FIG. 9*d* is a back view of loading door 100, which includes loading door safety interlock pendulum 103, loading door paint port 101, loading door closure tab 97, and loading door finger tab 105.

Figure 9E:
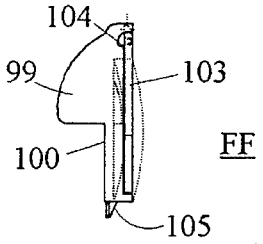
FIG. 9*e* shows Section FF of the loading door in a vertical position.

FIG. 9*e* shows Section FF (FIG. 9*a*), of loading door (100). It includes loading door safety interlock pendulum (103), loading door safety interlock stop (104), loading door safety cam (99), and loading door finger tab (105).

Figure 9F:
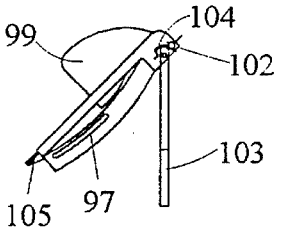
FIG. 9*f* is a side view of the loading door showing action of loading door safety interlock.
Figure 9G:
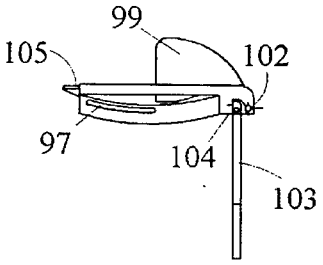
FIG. 9*g* is a side view of the loading door showing safety interlock pendulum at maximum travel, perpendicular to the loading door.
Figure 9H:
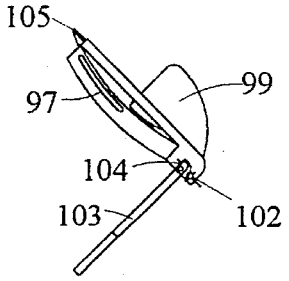
FIG. 9*h* is a side view of the loading door demonstrating maximum travel of safety interlock pendulum.

FIGS. 9*f–h* demonstrate the loading door safety interlock pendulum (103) travel limitation. Also included are loading door closure tab (97), loading door safety cam (99), loading door hinge pin (102), loading door safety interlock pendulum (103), loading door safety interlock stop (104), and loading door finger tab (105).

Figure 10:
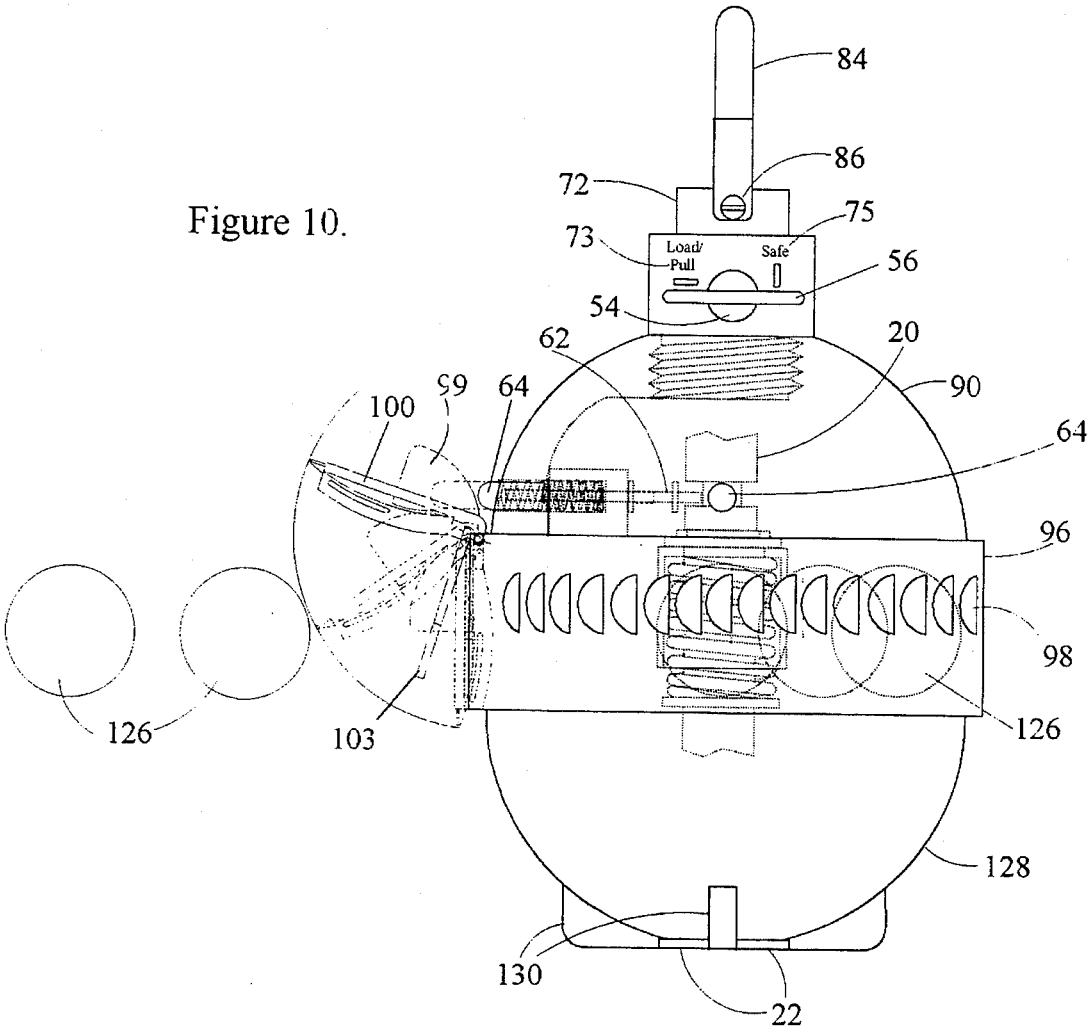
FIG. 10 is a side view of the grenade, showing travel of the loading door and default position of safety interlock pendulum.

FIG. 10 is a side view of a paint ball grenade showing travel of loading door (100) and loading door safety interlock pendulum (103) during initial preparation for reloading paint ball (126). Included is loading door safety cam (99) and its relationship to safety interlock handle (64) thru upper housing (90). Pin (54) is in the load/pull position as evidenced by pull ring (56). Bail (84) is attached to cap (72) by shoulder screw (86). Load/pull pin orientation marking (73) and safe pin orientation marking (75) are indicated on cap (72). Relationship of safety interlock pin (62) to center post (20) is shown. Paint ball (126) may be seen behind finger guard (96) and thru finger guard paint dispersal port (98). Lower housing (128) displays foot (130) placement and location of center post base (22).

Figure 11:
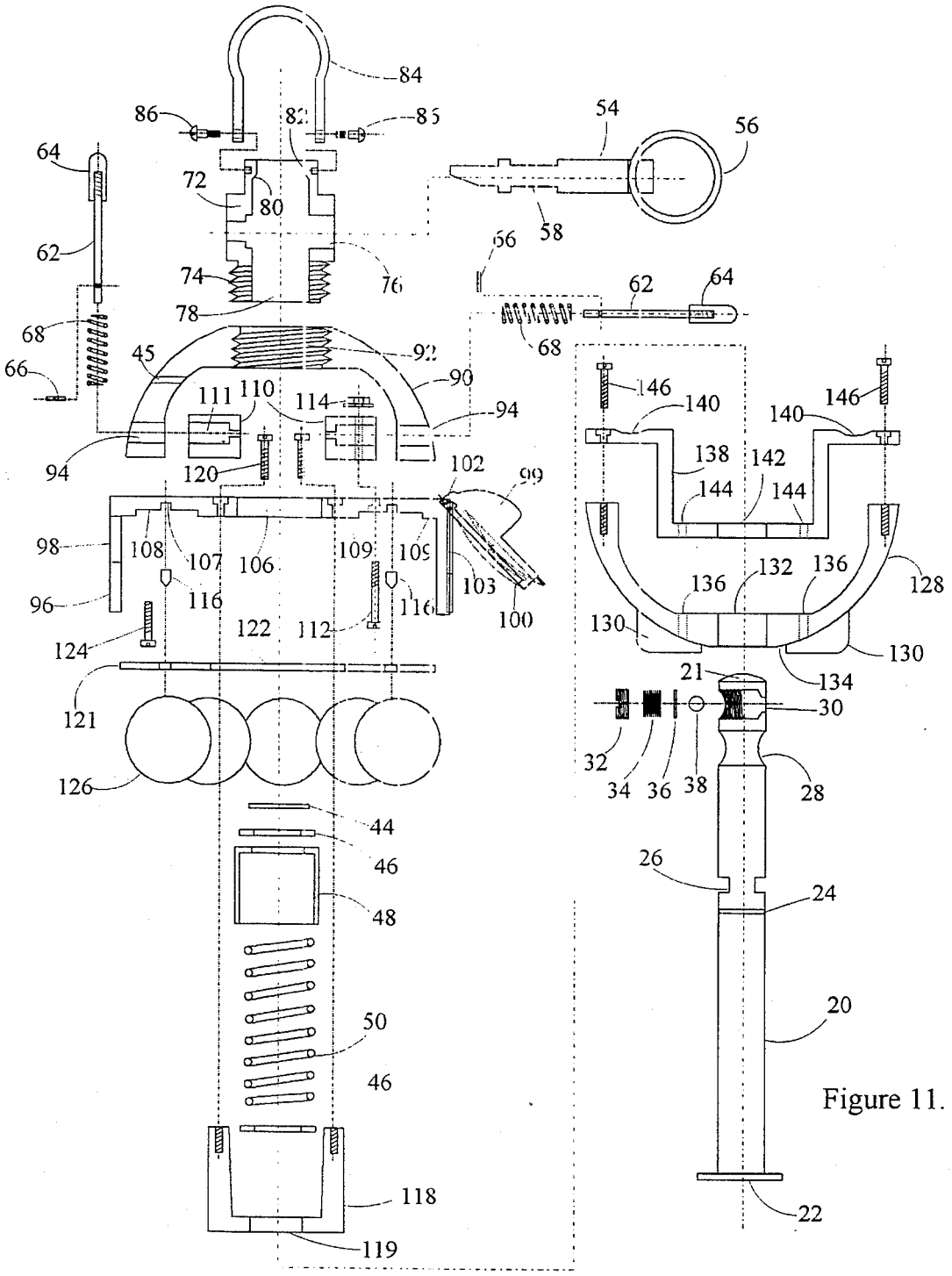
FIG. 11 shows an exploded view of Section AA with finger guard rotated 90 degrees to demonstrate position of loading door.

FIG. 11 shows an exploded view of Section AA (FIG. 3) with Finger guard (96) rotated (90) degrees to demonstrate position of loading door (100) and loading door safety interlock pendulum (103). Beginning at the top with bail (84) assembled to the cap (72) with shoulder screw (86). Cap (72) displays the longitudinal cap thru-hole for center post (78), the transverse cap thru-hole for grenade pin (76), as well as cap neck-down actuator interface (80), Cap bearing surface for center post (82), and male cap threads (74). Male cap threads (74) engage female upper housing threads (92) of upper housing (90) during assembly. Pin (54), with cam (58) and their relationship to pull ring (56) is also provided. Safety interlock handle (64) is attached to safety interlock pin (62), assembled thru safety interlock spring (68) and into safety interlock housing (110) before being secured with retaining clip (66). Safety interlock handle (64) is installed through upper housing thru-hole for safety interlock Handle (94) and safety interlock housing (110) secured to finger guard (96) with bolt (112) and captured locking nut assembly (114). Finger guard (96), contains finger guard paint dispersal port (98) and finger guard blind-hole for ball cutter (107), into which Ball cutter (116) is installed. Finger guard (96) also includes finger guard void for ball cutter retainer displacement (108), and provides finger guard race for ball cutter retainer (109), into which ball cutter retainer (121) is inserted. The bottom surface of ball cutter retainer (121) provides the upper surface for retaining paint ball (126). Core (118) is secured to the base of finger guard (96) in the center void of ball cutter retainer thur-hole for core (122). Core (118) is secured to finger guard (96) with core retaining screw (120). Loading door (100), with loading door safety cam (99) are attached to finger guard (96) with loading door hinge pin (102). lower housing (128) contains lower housing drain hole (136), lower housing thru-hole for center post (132) and foot (130). Installed above and within lower housing (128) is liner (138). Liner (138) contains liner paint ball race (140), liner drain holes (144), liner thru-hole for center post (142), and is attached to lower housing (128) with liner retaining screw ( 146). Liner paint ball race (140) of liner (138) provides the lower surface for retaining paint ball (126). Center post (20), with its center post base (22), center post thru-hole for power spring retaining pin (24), center post notch for safety interlock pin (26), center post thru-hole for grenade pin (28), center post thru-hole for actuator mechanism (30) terminates at the spherical center post top (21). Contained with center post thru-hole for actuator mechanism (30) of center post (20) is Actuator adjusting screw (32), actuator spring (34), actuator washer (36), and actuator ball (38). Power spring retaining pin (44) is installed thru retaining pin installation hole (45) of upper housing (90) and captures upper washer (46), power spring guard (48), power spring (50), and lower washer (46) above the core (118) as center post (20) passes thru core thru-hole for center post (119).

DESCRIPTION OF INVENTION—ALTERNATIVE EMBODIMENTS

As a Prepositioned Mine—A chord or wire may be secured to the Pull ring (56) so that the mechanical displacement of the pin (54) by pulling the wire would cause immediate functioning of the device.

As a Dispersal Device for Chemical or Biological Agents—The object of my invention may also be employed as a dispersal device for chemical or biological agents by employing 0.68 or smaller diameter capsules that have been filled with one or more of a variety of chemical agents.

OPERATION OF INVENTION—PREFERRED EMBODIMENT

Operation of my grenade is presented in five sequential procedures: inspection prior to use; resetting the power spring (50); uploading paint balls (126); deployment; and adjusting actuator sensitivity. Prior to use, all parts must be inspected to assure they are fully functional and free of dried paint. User should assure the free movement of safety interlock handles (64). Pin (54) should be available and undamaged. Actuator mechanism should be operational with adjusting screw (32) installed and actuator ball (38) clean and properly seated. Loading door (100) should be fully operational, free of accumulated paint with hinge (102) operational. Loading door safety cam (99) should engage and advance safety interlock handle (64). Loading door safety interlock pendulum should be free of dried paint, operating freely with safety interlock stop (104) operational.

Resetting power spring (50) is accomplished by grasping finger guard (96) with palm of hand while applying minimal force upon one or more safety interlock handles (64). Rotate bail (84) in either direction until transverse to longitudinal axis of grenade. Invert grenade and press center post spherical top (21) on hard surface. Force center post (20) into grenade until perimeter of center post spherical top (21) is flush with top of cap (72). As power spring (50) is compressed actuator ball (38) will engage cap neck-down actuator interface (80). One or more safety interlock handles (64) will engage center post notch for safety interlock pin (26). Insert pin (54) into cap thru-hole for pin (76) with the plane created by the pull ring (56) perpendicular to the grenade's longitudinal axis. Once inserted, rotate pin (54) until plane created by pull ring (56) is positioned parallel to longitudinal axis of grenade.

Load paint balls (126) after power spring (50) has been reset. Pin (54) and associated pull ring (56) must be rotated until plane created by pull ring (56) is perpendicular to longitudinal axis of grenade. Grenade length will increase slightly as the pin (54) cam (58) rotates to the load/pull position. Growth results in distance between top surface of liner (138) and the bottom surface of ball cutter retainer (121) increasing sufficiently to allow insertion of paint ball (126). Grasp finger guard with palm of hand, center post base (22) closest to loader's body, loading door (100) away from palm. Using loading door finger tab (105) open loading door (100) pivoting upward toward top of grenade. Loading door (100) will snap open as loading door closure tabs (97) disengage from the finger guard (96). As loading door (100) opens, loading door safety interlock pendulum covers opening and minimizes possibility of crush injury should other safety devices catastrophically fail. When loading door (100) reaches full travel, safety interlock handle (64) engages center post notch for safety interlock pin (26). Once loading door (100) is fully opened, loading door safety interlock pendulum (103) must be pivoted upward into loading door (100). Paint balls (126) may now be inserted into the opening created by loading door (100). When complete, loading door (100) should be closed until loading door safety interlock pendulum covers opening in finger guard (96), to preclude inadvertant insertion of fingers into paint ball (126) area. Pin (54) pull ring (56) should then be rotated 90 degrees (in either direction) causing pin (54) cam (58) to interlock with the spring loaded center post (20) precluding the inadvertent extraction of pin (54) while causing distance between the upper surface of the lower housing (128) liner (138) and the bottom surface of the ball cutter retainer (121) to be decreased sufficiently for paint balls (126) to align themselves in liner paint ball race (140). Alignment of paint balls (126) in liner paint ball race (140) simultaneously positions paint balls within functional proximity of ball cutter (116). Loading door should now be closed and snapped shut as loading door closure tabs (97) engage opening for loading door (100) in finger guard (96).

Deployment—grenade is typically worn onto playing field attached by bail (84) to various types of snap hooks on vest or belt. Deployment procedure involves removing grenade from vest or belt, grasping grenade with finger guard (96) in palm of hand while simultaneously pressing (engaging) one or more safety interlock handles (64). Rotate pin (56) pull ring (58) until plane created by pull ring (56) is perpendicular to the longitudinal axis of grenade. While maintaining engagement of one or more safety interlock handles, remove pin (56). As grenade travels downrange, spring loaded safety interlock handles(64) previously depressed will retract (disengage). Power spring (50) will be restrained by engagement of actuator ball (38) against cap neck-down actuator interface (80). Upon adequate jarring impact, the relationship between the two grenade halves, specifically those components attached to and including the upper housing (90) and those components attached to and including the lower housing (128) and center post (20) will change slightly. The distortion occurring at the minimal clearances that exist between center post (20) and core thru-hole for center post (119) and cap bearing surface for center post (82). Such distortion when combined with jarring action, causes the potential of compressed power spring (50) to overcome resistance created by actuator spring (34) causing spring loaded actuator ball (38) to retract into center post (20) thus allowing power spring (50) to expand. Expansion of power spring (50) causes liner (138) to close with ball cutter retainer 121. Continued compression of the paint balls (126) will cause ball cutter retainer (121) to deflect into finger guard void for ball cutter retainer displacement (108), exposing paint balls (126) to ball cutters (116) thus breaching the integrity of the paint ball (126) membrane. Orientation of paint balls (126) within the liner paint ball race (140) is irrelevant due to the total quantity and locations of the ball cutters (116). Simultaneous membrane breach reduces total potential required from power spring (50) to accomplish mission while minimizing potential delta in necessary crushing force created by inconsistencies in paint ball membranes. Continued expansion of power spring causes pressurization of released paint between liner (138), ball cutter retainer (121), and interior of finger guard (96). Acting as a non-positive displacement pump, continued closure of the liner (138) and ball cutter retainer (121) forces paint through finger guard paint dispersal ports (98), which have been designed to maximize the tradeoff between volume and dispersal distance. Core (118) acts as the upper housing (90) component terminus for the power spring while increasing the volumetric paint dispersal efficiency of the device. Alignment between the upper housing (90) and associated parts, and lower housing (128) and center post (20) and their collective associated pans, is provided by liner thru-hole for center post (142), core thru-hole for center post (119) and cap bearing surface for center post. Potential misalignment between the two housing halves requires clearance exist between core (118) and liner (138). This clearance allows pressurized paint to pass into the base of the liner (138), potentially preventing the complete closure of liner (138) and ball cutter retainer (121). Blow-by paint, accumulating in the base of liner (138) may drain into lower housing (128) through liner drain holes (144) and out of lower housing (128) through lower housing drain holes (136). Upon complete compression of paint balls (126) by the power spring (50), between liner paint ball race (140) and ball cutter retainer (121), the residual membranes collect in the liner paint ball race (140), thus maximizing the potential of the of the device. Subsequent to deployment and functioning, the power spring (50) can be reset and residual paint ball (126) membranes removed with the assistance of a small stick through the loading door (100), by rotating the lower housing (128) and associated parts in relationship to the upper housing (90) and associated pans. Care should be taken to assure one or more of the safety interlock handles (64) are completely engage before introducing any foreign device into the paint ball (126) area.

Adjust actuator setting—actuation sensitivity adjustments may only be done when the device is in the unloaded/functioned configuration. Procedure is accomplished by manipulation of the actuator adjusting screw (32) in order to increase or decrease the compression on actuator spring (34), thus increasing or decreasing the force necessary to cause the actuator ball (38) to retract into the center post (20), thus allowing the power spring (50) to function the device. Permanent actuator adjustment markings (40) on the center post (20) indicate direction actuator adjusting screw (32) must be turned to increase or decrease the sensitivity of the actuator mechanism.

OPERATION OF INVENTION—ALTERNATIVE EMBODIMENTS

As a Prepositioned mine—the object of my invention may also be used as a prepositioned mine by screwing actuator adjustor screw (32) counterclockwise until the force placed upon actuator spring (34) is inadequate to preclude the power spring (50) from causing the device to function. By eliminating the actuator ball's (38) resistance, the loaded the device, when secured appropriatelly to produce the desired dispersal effects, will function when the pin (54) is removed. To do this remotely, in person, or with trip wire, the pin (54) pull ring's (56) plane must be perpendicular to the longitudinal axis of the grenade. A chord or wire may be secured to the pull ring (56) so that the mechanical displacement of the pin (54) by pulling the wire would cause immediate functioning of the device.

Dispersal device for chemical agents—the aforementioned paint ball grenade may be employed to deliver and disperse a variety of flammable or chemical agents by law enforcement or government military organizations. Any 0.68 or smaller capsule may be loaded into the device for remote deployment without the complications of explosive timing devices typically necessary in the dispersal of chemical substances. Conceivably the device could be utilized for the deployment of leathal and nonleathal binary chemical and biological weapons currently under development. The advantage to this design is its simplicity and lack of expensive mechanical fuze-like timing mechanism that are highly suseptable to the corrosive characteristics of many of todays chemical munitions.

CONCLUSIONS, RAMIFICATIONS, AND SCOPE

Accordingly, it can be seen that my invention provides numerous advantages over the prior art. They include but may not be limited to: its superior size, weight and aerodynamic characteristics; its incorporation of a bail by which it may be secured and transported prior to deployment; it may be stored in a wide variety of environments, unaffected by extreme heat or cold until after it is uploaded; it has a predetermined and predictable dispersal pattern; it is easily refillable and reusable; it cannot be reloaded and reused during a Paint Ball game by anyone not possessing the appropriate grenade pin, thereby reducing the possibility of being claimed and used against its owner; it has multiple safety interlocks to minimize inadvertent actuation and physical restraints to preclude injury in the event of catastrophic failure; it has an adjustable actuator; it can be easily uploaded to change or blend color combinations at will; and it contains an internal environmentally friendly renewable power source that facilitates its use as mine-like device actuated by any of a variety of mechanical triggering mechanisms.

Although the description above contains many specificities, these should not be construed as limiting the scope of the invention but as merely providing illustrations of some of the presently preferred embodiments of this invention. Various other embodiments and ramifications are possible within it's scope. For example, it may have applications in a variety of civil law enforcement, and even military environments. When uploaded with other than standard paint balls (126), the device has application as a neutralizing agent for chemical spills, or even a fire extinguisher that could be loaded, targeted, deployed, and actuated under extreme conditions. The size of the device may be varied to accommodate a variety of individualized applications, while the capacity of the munition (preferred embodiment was paint ball (126)) may be varied without direct relationship with overall device size. Composition of device can vary in accordance with available materials and economic considerations. A variety of man made and naturally occurring, or combination of the two could be employed during construction. The device could be made completely of nonmetallic materials if nondisclosure by metal detectors was advantageous.

Thus the scope of the invention should be determined by the appended claims and their legal equivalents, rather than by the examples given.

What is claimed is:

1. A paint ball grenade comprising;

a base member comprising a generally semi-spherical hollow shell having a lining extending across the open end thereof;

a top member comprising a generally semi-spherical hollow shell having a planar member extending across the open end thereof, said planar member being located opposite to and in facing relationship with the lining, and a hollow tubular cap member defined by a wall centrally secured to and extending upwardly and outwardly from the top member shell, said cap having a pair of apertures located opposite each other in the wall thereof;

a post extending upwardly from the base member shell, through the hollow interiors of the base member shell and top member shell and into the tubular cap member, said post having a bore extending transversely there through the upper end thereof, said post being fixed relative to the base member shell and the top member and cap being slidably moveable along the post between a first position in which the liner and planar member are spaced apart by a gap sufficient to receive there between one or more paint balls and the apertures in the cap are aligned with the bore in the post, and a second position wherein said liner and planar member substantially abut for squeezing paint from any paint ball positioned therebetween;

a spring connected between the post and top member for biasing the latter to the second position;

a depending guard member secured about the top member and extending toward the base member a distance sufficient to cover the gap when the top member is in the first position to guard against a user inserting a finger between the liner and planar members and to help retain any paint ball positioned in the gap within the grenade, said guard member having one or more paint dispersal ports to permit expulsion of paint from the interior of the grenade when the top member moves from the first to the second positions, and also having a door for insertion of paint balls into the gap when the top member is in the first position;

a safety pin for insertion through the apertures in the wall of the cap and bore of the post when the top member is in the first position for locking the top in that position against movement to the second position and;

means interacting between the top member and post for temporarily holding the top member in the first position when the pin is removed and for releasing the top member for movement to the second position under the influence of the spring upon the application of an impact force to the grenade;

whereby one or more paint balls may be inserted into the grenade through the door into the gap when the top is held in the first position by the pin, the pin may be removed and the grenade thrown, and upon impact the top member will slide along the post to close the gap, squeezing the paint balls to rupture them and release the paint therefrom for ejection through the ports.

2. A paint ball grenade as recited in claim 1 and further comprising one or more paint ball cutters secured to one of the liner and planar members and facing the other for cutting the paint balls when the top member moves from the first position to the second position to facilitate their rupture.

3. A paint ball grenade as recited in claim 1 and further comprising depressible safety interlock means extending outwardly of the top member adjacent the door in a position to be depressed when the door is opened for temporarily latching the top in the first position when the door is opened.

4. A paint ball grenade as recited in claim 1 and further comprising means for constraining paint released from the paint balls to remain in the gap to maximize the amount thereof ejected through the ports and the force of ejection.

* * * * *